United States Patent [19]

Östbo

[11] Patent Number: 4,782,892

[45] Date of Patent: Nov. 8, 1988

[54] HEAT EXCHANGER

[76] Inventor: Karl Östbo, Fredhällsgatan 7, Stockholm, Sweden, 11254

[21] Appl. No.: 104,542

[22] PCT Filed: Aug. 22, 1984

[86] PCT No.: PCT/SE84/00282

§ 371 Date: Apr. 16, 1985

§ 102(e) Date: Apr. 16, 1985

[87] PCT Pub. No.: WO85/01101

PCT Pub. Date: Mar. 14, 1985

Related U.S. Application Data

[62] Division of Ser. No. 726,904, Apr. 16, 1985, abandoned.

[30] Foreign Application Priority Data

Aug. 26, 1983 [SE] Sweden ..... 8304626

[51] Int. Cl.[4] ..... F28D 7/02; F28F 1/14

[52] U.S. Cl. ..... 165/164; 165/183

[58] Field of Search ..... 165/154, 164, 165, 183

[56] References Cited

U.S. PATENT DOCUMENTS

| | | | |
|---|---|---|---|
| 1,821,434 | 9/1931 | Hamilton | 165/183 X |
| 1,840,651 | 1/1932 | Bassler | 165/165 X |
| 1,952,896 | 3/1934 | Rudorff | 165/183 |
| 2,405,722 | 8/1946 | Villier | 165/183 X |
| 2,779,972 | 2/1957 | Keni | 165/164 |
| 3,467,180 | 9/1969 | Pensotti | 165/183 X |
| 3,493,042 | 2/1970 | Burne et al. | 165/183 |
| 3,602,298 | 8/1971 | Ciesielski | 165/183 |
| 4,487,256 | 12/1984 | Lutzene et al. | 165/183 X |

FOREIGN PATENT DOCUMENTS

| | | | |
|---|---|---|---|
| 1558292 | 3/1970 | Fed. Rep. of Germany | 165/183 |
| 69269 | 10/1958 | France | 165/183 |
| 69567 | 11/1958 | France | 165/183 |
| 74384 | 11/1960 | France | 165/183 |
| 1534246 | 7/1968 | France | 165/183 |
| 396072 | 9/1973 | Sweden | 165/181 |
| 1209739 | 9/1970 | United Kingdom | 165/183 |
| 1379511 | 1/1975 | United Kingdom | 165/181 |

*Primary Examiner*—Michael Koczo
*Assistant Examiner*—Peggy Neils
*Attorney, Agent, or Firm*—Holman & Stern

[57] ABSTRACT

In order to improve the transfer of heat within a heat exchanger one or more tubes are provided for a heat transporting medium, and are embedded by casting into a block of an aluminum alloy, or some other metal having high heat conducting capacity. The block is at its outward faces provided with surface-enlarging flanges, and is enclosed in a casing which defines a passage for a second heat transporting medium flowing around the block. A block can be prismatic or annular, and a number of blocks can be fitted within the same casing.

6 Claims, 6 Drawing Sheets

Figure 1:
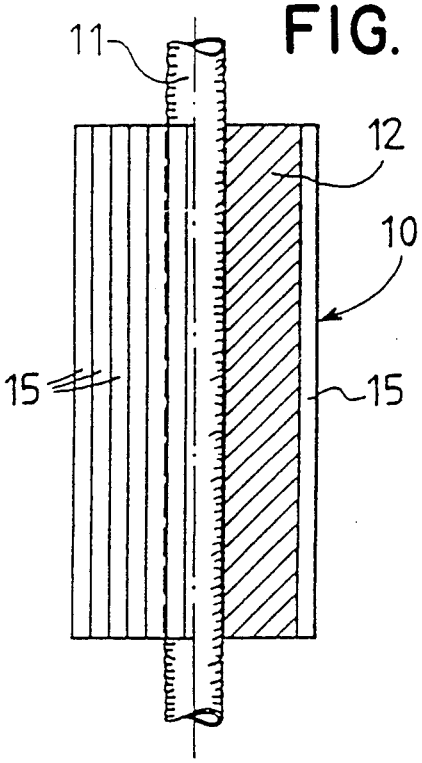

FIG. 8
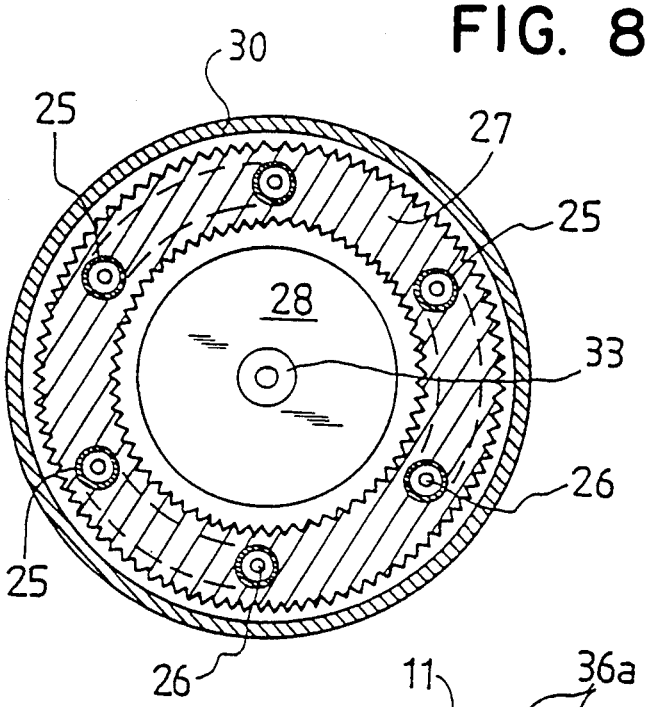
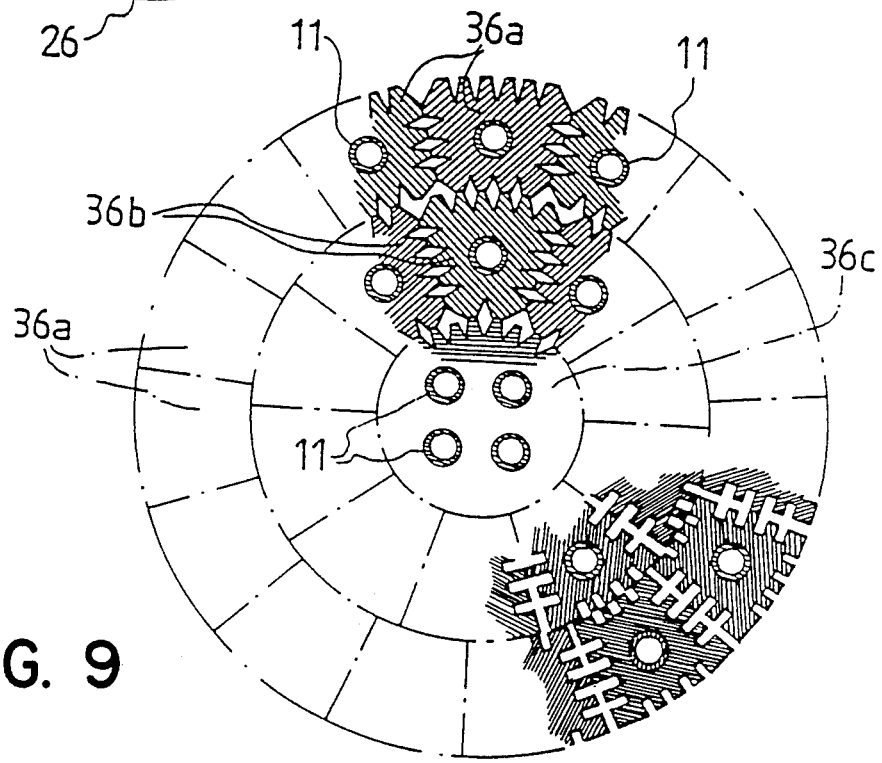
FIG. 9

FIG. 10
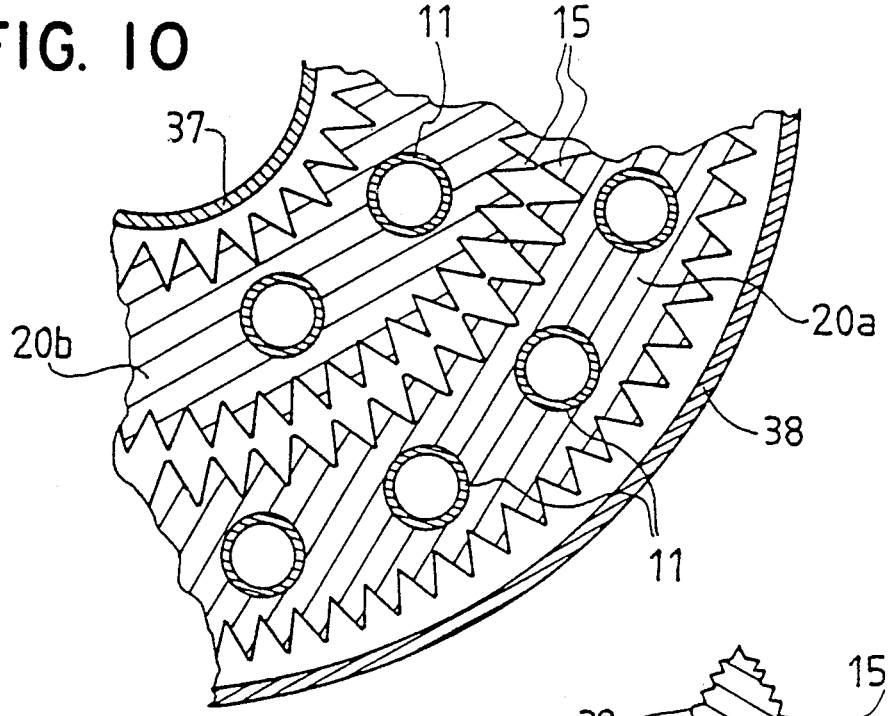
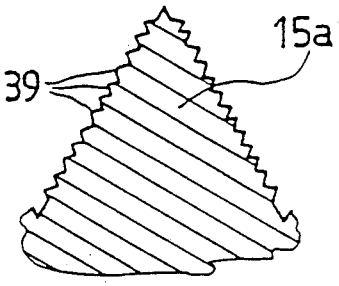
FIG. 11
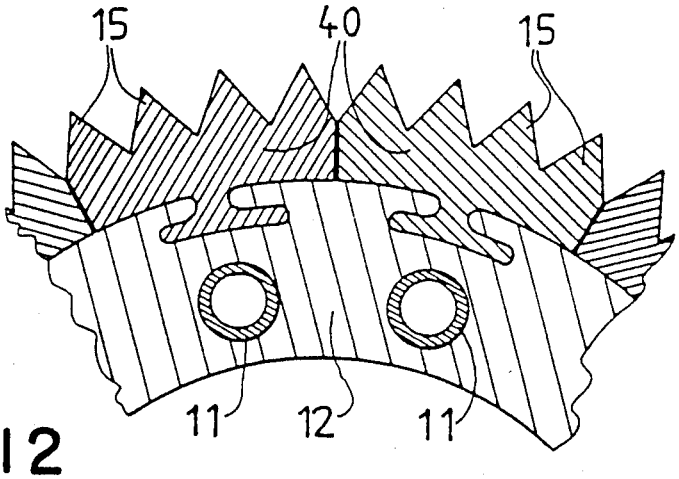
FIG. 12

HEAT EXCHANGER

This is a divisional of application Ser. No. 726,904, filed Apr. 16, 1985 now abandoned which in turn is:

This U.S. application stems from PCT International application No. PCT/SE84/00282 filed Aug. 22, 1984.

The heat transfer between two heat transporting media is influenced by many factors, but it is obvious that it is advantageous to provide for a good contact between the various components. When the transportation path includes components of different kinds and possibly also of different materials the inventor has found that a superior method of ensuring a high heat conductivity is to embed one component into an other by casting.

The aim of the present invention is to propose a heat exchanger having high heat transmission properties, and which is characterized in that the core includes at least one block of a metal having a high heat conducting capacity, into which at least one tube for the first medium is embedded by casting, and which at its inward and/or outward face is provided with surface enlarging flanges to present contact surfaces towards the second medium several times larger than what the tube(s) presents towards the first medium.

The block may be prismatic and encloses a number of tubes. Alternatively the block may be annular.

In order to improve the heat transfer from, or to, a block in which the flanges run in parallel to its longitudinal axis the flanged face of the block is cut transversely by grooves subdividing the face into fields wherein the flanges in one field are displaced sidewardly so as to be aligned with the gaps in an adjacent field in order to provide a tortuous flow path for the second medium along said face of the block.

The bonding between the tube and the metal as well as the heat transfer therebetween is enhanced by the outward face of the tube being rugged. The tube is preferably made of stainless steel, which is better suited than the material in the block to withstand corrosion, and which also has good bonding properties with respect to the enclosing metal.

A number of flanges can advantageously be formed in an extruded bar of metal, adapted, together with further bars, to form a mould into which the tube enclosing block is cast.

In a heat exchanger comprising a number of blocks mounted within the same casing the flanges in one of the blocks may extend into gaps between flanges in an other block. Alternatively the flanges at juxtaposed block faces may meet edge to edge.

A number of panel-shaped blocks, each including at least one row of first medium transferring tubes may be fitted within a casing, which is passed through by a heat transporting gas, and where the tubes are connected to distribution and collecting headers for the first fluid.

The first heat transporting medium may be electric current, in which case a number of tubes enclosing electric resistances are cast into a tubular block, which is interiorly and exteriorly contacted by a heat removing fluid.

Figure 2:
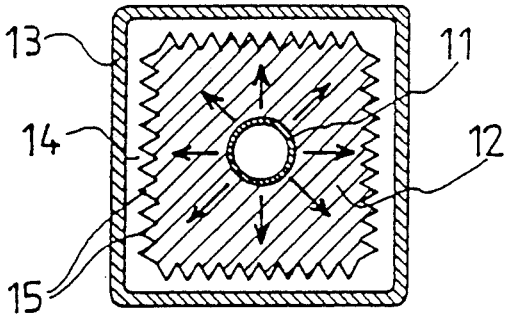
Figure 3:
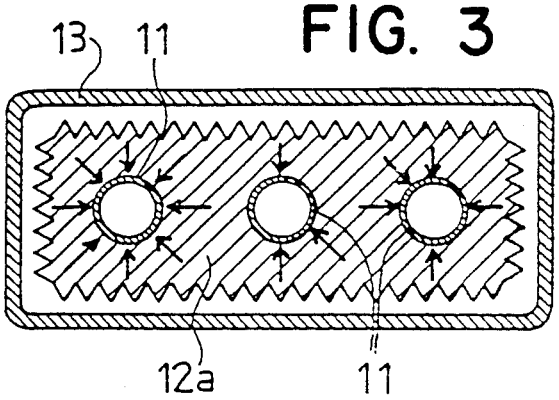
Figure 4:
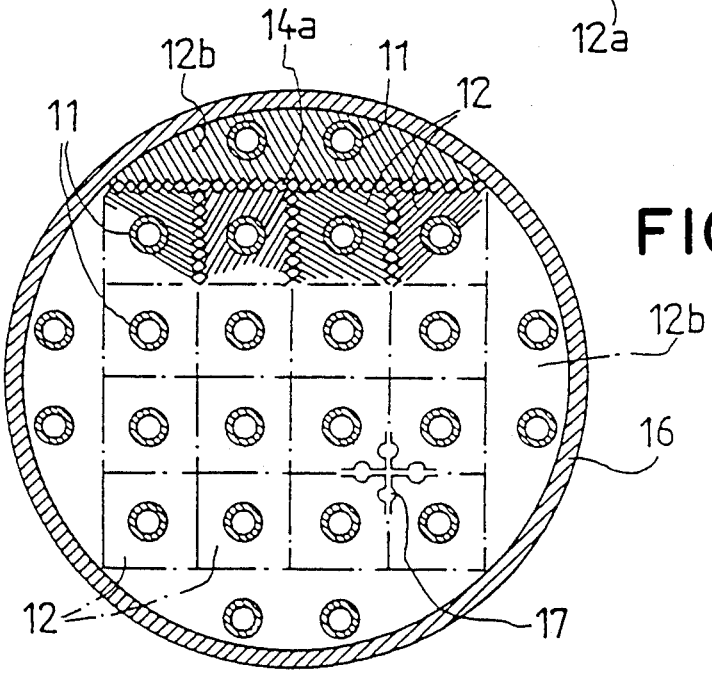
Figure 5:
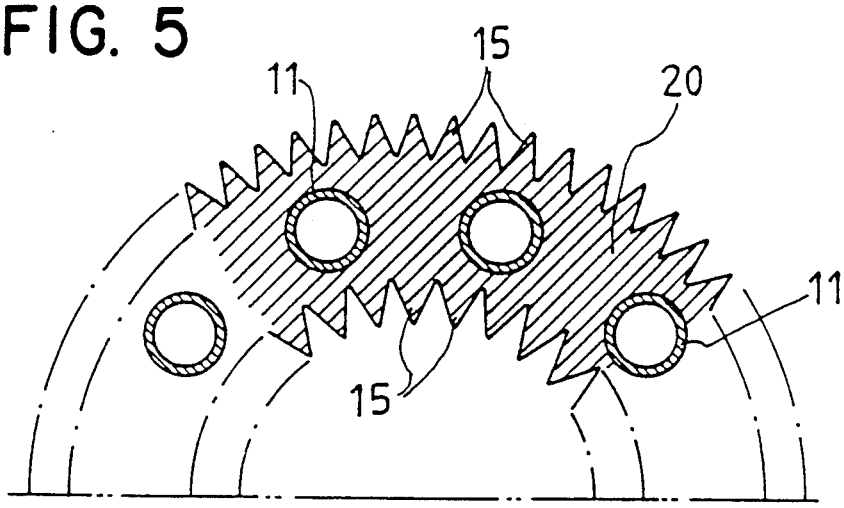
Figure 6:
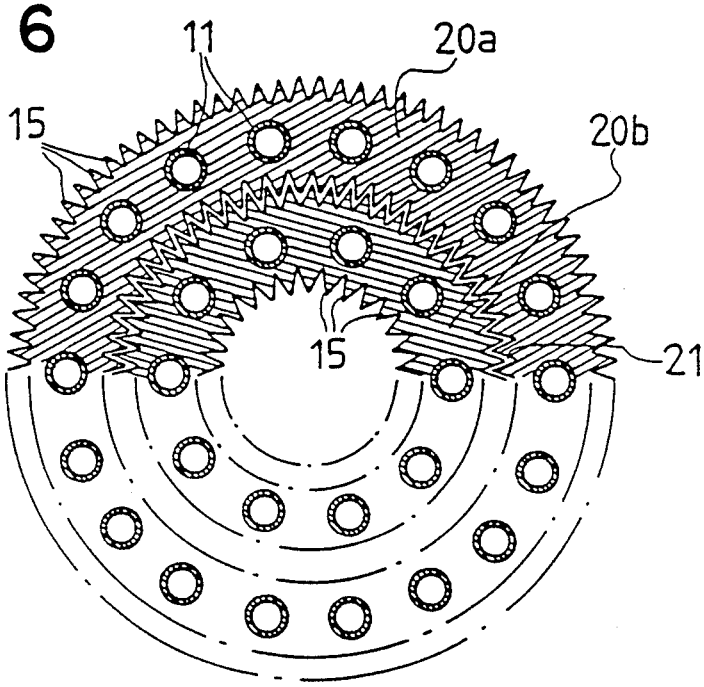
Figure 7:
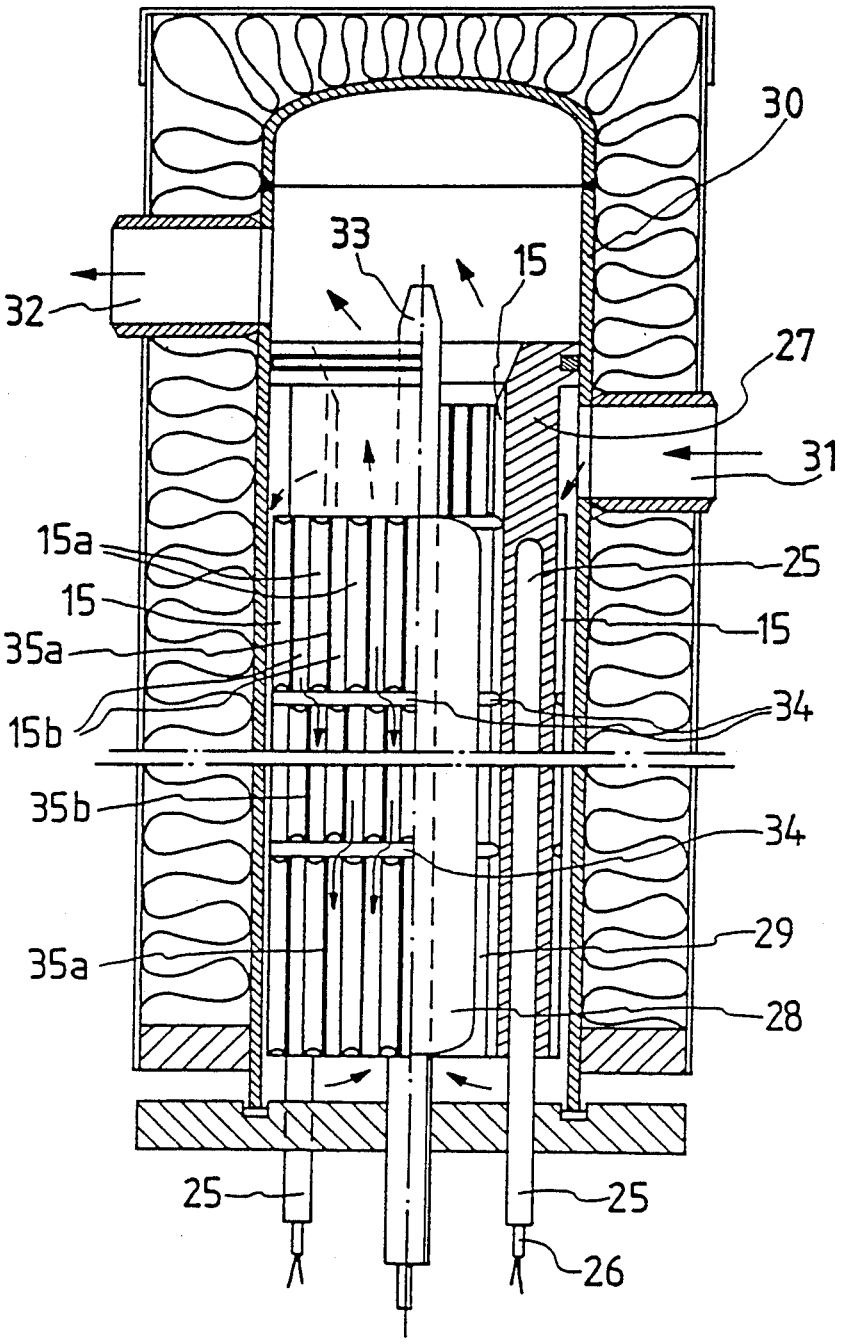
Figure 13:
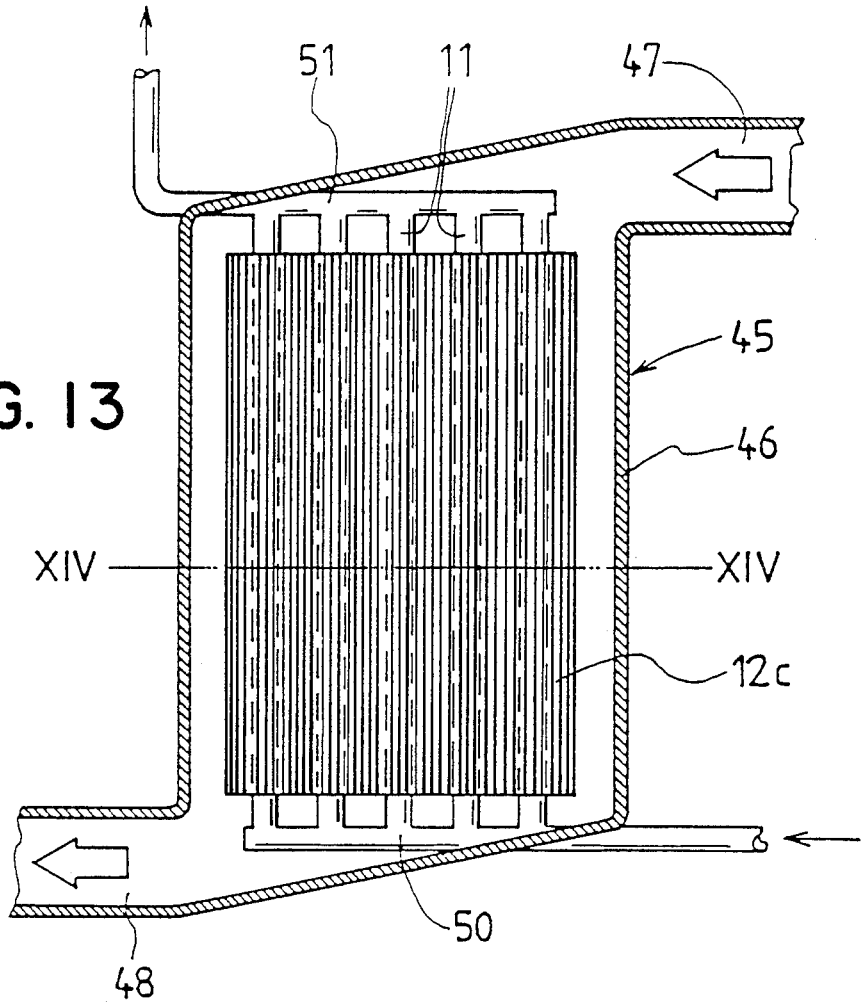
Figure 14:
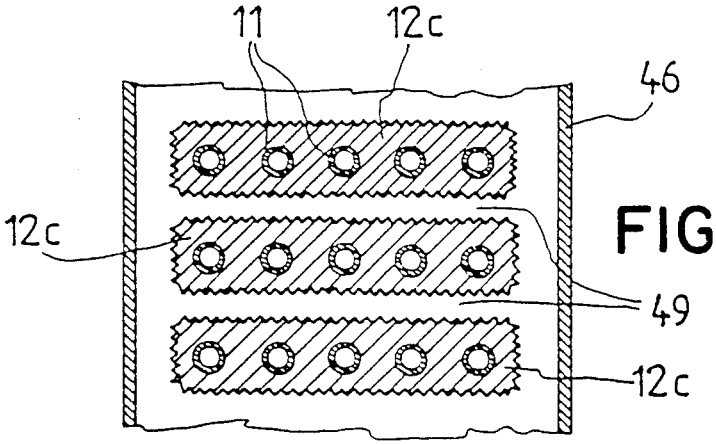

The invention will below be described with reference to the accompanying drawings, in which FIG. 1 schematically shows a heat exchanger element according to the invention, FIG. 2 shows a cross section through a heat exchanger containing an element according to FIG. 1, FIG. 3 shows a cross section through a heat exchanger, similar to that of FIG. 2, but having a bigger element, FIG. 4 shows a heat exchanger having elements of a modified form, FIG. 5 shows a detail of a heat exchanger element of a further modified form, FIG. 6 shows a detail of a heat exchanger having heat exchanger elements according to FIG. 5, FIG. 7 shows a longitudinal section through a exchanger heat by electric resistance elements, FIG. 8 is a cross section through the heat exchanger according to FIG. 7, FIG. 9 shows a cross section through a heat exchanger core composed of several elements, and suited for instance for use with a heat exchanger according to FIG. 7, FIG. 10 shows a detail of a heat exchanger comprising two heat exchanger elements according to FIG. 5, FIG. 11 shows, on a larger scale, a detail of a surfaceenlarging flange at a heat exchanger element, FIG. 12 shows a detail of an element where the surfaceenlarging flanges are formed in profile bars usable as a mould when casting the element, FIG. 13 shows a section through a heat exchanger according to the invention as used in an exhaust boiler, and FIG. 14 shows a cross section along line XIV—XIV in FIG. 13.

FIG. 1 shows a basic type of heat exchanger element 10, comprising a tube 11 for a first heat transferring medium, which is cast into a block 12 of a metal having good heat conducting capacity, for instance aluminum or some alloy thereof. This element will be mounted in a casing 13 (FIG. 2), which encloses the element with a clearance 14, so a passage for a second heat transporting medium is formed. Alternatively a number of such elements may be mounted in spaced relationship.

A better bonding between the tube and the metal, and also an improved heat transfer is obtained if the outward face of the tube 11 is rugged, or provided with transversely running rills.

The flanges will increase the contact surface area in relation to the second medium, to be five to ten times that of the contact area between the tube and the first medium. That will compensate the difference in heat transfer coefficients, which often puts a limit to the heat load upon heat exchangers.

In order to improve the heat transfer to the second medium the block is provided with flanges 15. Depending upon the direction of flow of the second medium the flanges may be arranged in parallel to, or perpendicularly to the longitudinal axis of the tube 11. On occasions when the block is tubular, the flanges may possibly run in a helical path around the outer envelope face of the element. The flanges are preferably formed during the casting, but may be formed by mechanical working.

As will be better explained in conjunction with FIG. 7 the flanges should preferably not run uninterruplidly along the face of the blocks, but should be staggered so as to provide a tortuous flow for the second medium.

A number of elements of the basic type shown in FIG. 1, and having varying cross sectional shapes may be built together within a common casing, but it is also possible, as is indicated in FIG. 3, to embed a number of parallel tubes 11 within the same block 12*a*, to be located in an enclosing casing 13.

In FIGS. 2 and 3 arrows directed radially towards, or away from the tubes, will indicate the direction of the concentrated flow of the heat around the tubes. Due to the intimate metallic contact between the two components the heat transfer will be very intense.

FIG. 4 shows a heat exchanger containing a number of elements 12 according to FIG. 1, as well as four elements 12*b* of a specific shape, which together form a cylindrical body enclosed in a tube 16, which hold the various components together.

Passages 14a for the second heat transferring medium will remain between the various elements. The tubes 11 may be connected in parallel, but can obviously, for instance groupwise, be connected in series. On such occasions suitable distribution and collecting headers are provided at the ends of the elements.

The heat exchanger package shown in FIG. 4 may be enclosed in a casing, which defines a flow path for the second heat transferring medium, outside the tube 16. The flanges 15 may be shaped in different ways, and as is indicated at 17 in the lower, right part of the figure, they may be defined by half-circular grooves.

FIG. 5 shows annular block 20, in which a number of tubes 11 are embedded. This block is interiorly, as well as exteriorly, provided with surface-enlarging flanges 15.

FIG. 6 shows components for a heat exchanger comprising concentric annular blocks 20a, 20b of different diameters. The blocks are fitted together, so the flanges 15 at one element fit into the gaps between flanges 15 at the other element. In this manner a restricted zig-zag shaped passage 21 for the second heat transferring medium will be formed between the blocks.

In the embodiments described above the tubes 11 have been adapted to receive a fluid—in form of a liquid or as steam—but the first heat transferring medium can very well be electric current, which by embedded resistance elements is transformed into heat.

FIGS. 7 and 8 shows an electrically heated oil preheater. Three tubes 25, bent into U-shape, and enclosing electrical resistances 26 are embedded in an annular block 27 of the same type as that shown in FIG. 5, and here provided with internal and external surface-enlarging flanges 15. A filler body 28 is fitted centrally in the block, and defines a passage 29 along the inward face of the block.

Oil is introduced into the enclosing casing 30 at 31, and flows exteriorly around the block 27, makes a 180° turn, and flows through passage 29 towards an exit 32.

A temperature sensor 33 extends radially through the filler body and presents its inward end adjacent to the exit 32. The sensor will in a well known manner govern the supply of electric current to the resistances 26.

A smooth flow along a surface may tend to provide a poor heat transfer, and in order to improve the heat transfer the flanged face of a block is preferably cut up into fields where the flanges in one field are displaced sidewards so as to be aligned with the gaps in a following field. Hereby a tortuous flow of the second medium is ensured.

In FIG. 7 the outward, as well as the inward face of the annular block 28 is cut by grooves 34, transversely to the longitudinal axis of the block. In this manner the contact faces of the block are subdivided into fields 35a, b, in which the flanges 15a of one field are displaced sidewards so as to be aligned with the gaps 15b of the adjacent field.

A limiting factor with conventional electric oil heaters, where the resistance-enclosing tubes come into direct contact with the oil, is that the load cannot exceed 1,5–2 W/cm$^2$. Otherwise there is an apparent risk of the oil coking at the outward face of the tube.

In the present embodiment the load upon the block faces can remain at a value which is safe with respect to coking, but the load upon the electric resistances can be increased considerably, which means that the overall size of the heat exchanger, for the same heating capacity, will be much smaller than a conventional electric oil heater FIG. 9 shows a further modified embodiment composed of a number of cast blocks 36a, 36b, 36c, each enclosing a number of tubes 11. This embodiment may be regarded as a modification of the one shown in bar-like members.

The central block 36c may very well be used instead of the filler body 33 with the embodiment according to FIGS. 7 and 8.

On many occasions U-shaped tubes with enclosed electric resistances as indicated in FIG. 8—are preferable. The shape of a bar will then be more like that of FIG. 3, where the central tube void may house the temperature sensor, while the two outer tube voids are united into a U-shape.

FIG. 10 shows a detail of a modified arrangement of components similar to those of FIG. 6. Here, however, the annular blocks 20a, 20b are fitted so the flanges 15 meet edge to edge.

The blocks are here fitted between inner and outer casings 37 and 38, respectively.

As is mentioned above the flanges can be differently shaped. With bigger units it is possible to provide also the individual flanges 15a with ribs or fins 39—see FIG. 11—in order further to enlarge the contact surface passed by the second medium.

On occasions it may, as is shown in FIG. 12, be advantageous to locate the flanges 15 at separate, extruded profile bars 40 of the same material as in the block 12. These profile bars are shaped and arranged to permit them being used as an exterior mould for casting the block and will adhere permanently thereto. This will simplify the casting of bigger units, and also make them cheaper than units cast as unitary bodies with flanges. It will sometimes be difficult to remove a flanged block from an enclosing mould, but by using the flange-bearing bars to form part of first the mould and then the block, this difficulty to set aside.

In the embodiments described above the second medium has been a fluid, but the invention may also be used with heat exchangers, where the second medium is gaseous, for instance being exhaust gases from an internal combustion engine or a process plant.

FIGS. 13 and 14 show, very schematically, a hot-water boiler 45 heated by exhaust gases from an internal combustion engine (not shown).

A number of panel-shaped blocks 12c, similar to that of FIG. 3, but each enclosing a larger number of tubes 11, are arranged side by side within a casing 46, which is flown through by hot gases from an inlet 47 to an exit 48. The panels are fitted within the casing in such a manner that the gases are forced to pass also through passages 49 between the panels, The tubes 11 are connected to distribution and collecting headers 50 and 51, respectively, and the boiler is provided with conventional governing and supervision equipment (not shown).

The embodiments described above and shown in the drawings are examples only, and it is evident that the blocks of the basic type shown in FIG. 1 can be shaped and combined in may ways within the scope of the appended claims.

As is indicated in the lower part of FIG. 9 the gaps between the flanges may be defined by substantially parallel walls, the flanges thus obtaining flat edge surfaces. By making a centrally located flange at the individual blocks slightly higher than the adjacent flanges, it is possible to ensure a definite distance between the blocks, and furthermore the flow passage between the blocks will be subdivided into parallel paths.

An obvious advantage with the cast blocks is that they are more easy to clean than previous embodiments with parallel washers or discs mounted upon the tubes.

If the block panels with the embodiment according to FIGS. 13, 14 are mounted so the flanges intersect as is shown in FIG. 6 it is possible in a simple manner to determine the area of gas passages by parallel displacement of the block panels. In this manner it will be possible to vary the velocity of the gas flow, and thus also the heat transfer coefficient.

What is claimed:

1. A heat exchanger, comprising:

a core provided with a plurality of first passages therethrough for a first heat transporting medium, said core being enclosed in an outer casing with a clearance therebetween providing a second passage for the flow of a second heat transporting medium over said core, said core including a plurality of elongate metal blocks having four side faces and a high heat-conducting capacity, each of said blocks enclosing at least one of said first passages, the side faces of said blocks having outwardly projecting flanges running parallel to the general direction of flow of said second medium, for contacting said second medium, wherein each of said flanged side faces is formed with grooves therein extending transversely to the longitudinal axis of the block for subdividing each said flanged side face into plural adjacent fields, the flanges of each field being displaced in a sidewardly direction relative the flanges in, a following field so as to be aligned with the gaps between adjacent flanges in said following field, said blocks being packed closely together within said casing to provide a plurality of flow paths for said second medium between juxtaposed flanged side faces of said blocks and between outwardly facing flanged side faces thereof and said casing, thereby providing a plurality of tortuous flow paths for said second medium along said flanged side faces of said elongate blocks.

2. A heat exchanger, comprising:

a core provided with a plurality of first passages therethrough for a first heat transporting medium, said core being enclosed in a cylindrical outer casing defining a flow path for a second heat transporting medium in a second passage outside said core, said core including a plurality of elongate metal blocks having four side faces and a high heat-conducting capacity each enclosing at least one of said first passages, the side faces of said blocks being provided with outwardly projecting flanges running parallel to the general direction of flow of said second medium for contacting said second medium, said core further including a plurality of shaped elements provided with outwardly projecting flanges along one side face thereof and each enclosing at least one of said first passages, said plurality of shaped elements and said plurality of blocks together forming a cylindrical body enclosed in a tube, said tube holding said blocks and said shaped elements together, each of said side faces having transverse grooves disposed therealong in fields, wherein the flanges in one field are in relatively displaced relationship in a sidewardly direction to an adjacent block so to be aligned with the grooves between adjacent flanges in an adjacent field, said blocks being packed closely together to form a square section core, flanges of facing ones of said blocks and shaped elements meeting edge-to-edge with one another in order to provide a plurality of flow passages for said second medium in the gaps between flanges of the juxtaposed faces of said blocks and shaped elements in order to provide a flow path for said second medium along said faces of said blocks, said shaped elements being sector-shaped and having a chordal length approximately equal to a side of said square section body.

3. A heat exchanger comprising:

a core having a plurality of first passage for a first heat transporting medium extending therethrough, said core being enclosed in a casing governing the flow of a second heat transporting medium in a second passage outside said core, said core including a plurality of elongate blocks of a cast metal each having four side faces and a high heat conducting capacity, at least one tube having a rugged outward face and forming one of said first passages being embedded in each said elongate block and integral therewith, the side faces of said blocks being each provided with outwardly projecting flanges running parallel to the direction of elongation of said blocks for presenting contact surfaces to said second medium, the flanged side faces of each of said blocks being cut by transverse grooves therein interrupting and subdividing each said flanged side face into plural flanged fields, the flanges of each said field being displaced laterally in relation to the flanges of a respective following field whereby the flanges of each said field are aligned with gaps between the flanges of the respective preceding and following fields, said blocks being packed closely together within said casing, a plurality of flow paths for said second medium being defined by gaps between juxtaposed flanged side faces of said blocks and between outwardly facing faces of said blocks of said core and said casing thereby providing a plurality of tortuous flow passages for said second medium along said side faces of said blocks.

4. A heat exchanger according to claim 1, wherein gaps between said outwardly projecting flanges are defined by substantially parallel walls, said flanges having flat edge surfaces, a centrally-located flange of each block being slightly higher than flanges adjacent thereto, whereby a definite distance between blocks is ensured.

5. A heat exchanger according to claim 1 wherein flanges in one of the blocks extend into gaps between flanges in another block.

6. A heat exchanger according to claim 1 wherein flanges at juxtaposed block faces meet edge to edge.

* * * * *